US007245259B2

(12) United States Patent
Puckey et al.

(10) Patent No.: US 7,245,259 B2
(45) Date of Patent: Jul. 17, 2007

(54) MULTIPLE ANTENNA DIVERSITY ON MOBILE TELEPHONE HANDSETS, PDAS AND OTHER ELECTRICALLY SMALL RADIO PLATFORMS

(75) Inventors: Steven Puckey, Cambridge (GB); Steven Martin, Cambridge (GB); Tim John Palmer, Cambridge (GB); James William Kingsley, Cambridge (GB); Simon Philip Kingsley, Cambridge (GB)

(73) Assignee: Antenova Ltd., Cambridge (GB)

( * ) Notice: Subject to any disclaimer, the term of this patent is extended or adjusted under 35 U.S.C. 154(b) by 0 days.

(21) Appl. No.: 10/544,478

(22) PCT Filed: Feb. 9, 2004

(86) PCT No.: PCT/GB2004/000511

§ 371 (c)(1),
(2), (4) Date: Aug. 4, 2005

(87) PCT Pub. No.: WO2004/070874

PCT Pub. Date: Aug. 19, 2004

(65) Prior Publication Data

US 2006/0097919 A1 May 11, 2006

(30) Foreign Application Priority Data

Feb. 7, 2003 (GB) ..... 0302818.0

(51) Int. Cl.
*H01Q 1/38* (2006.01)

(52) U.S. Cl. ..... 343/700 MS; 343/846

(58) Field of Classification Search ..... 343/700 MS, 343/702, 829, 846
See application file for complete search history.

(56) References Cited

U.S. PATENT DOCUMENTS 5,453,754 A * 9/1995 Fray ..... 343/789
5,828,346 A 10/1998 Park
5,952,972 A * 9/1999 Ittipiboon et al. ... 343/700 MS (Continued)

FOREIGN PATENT DOCUMENTS

EP 0 720 252 7/1996
WO WO 2003/103087 12/2003

OTHER PUBLICATIONS

"Annular planar monopole antennas", Z. N. Chen, et al., IEE Proc. -Microw, Antennas Propag., 149, 4, 200 - 203, 2002.

(Continued)

*Primary Examiner*—Tho Phan
(74) *Attorney, Agent, or Firm*—Pearl Cohen Zedek Latzer LLP

(57) ABSTRACT

There is disclosed an antenna device including a dielectric substrate having a first, upper surface and a second, lower surface, a conductive groundplane on the second surface or located between the first and second surfaces. At least two conductive feedlines are formed on the first surface and extend from feed points to predetermined radiating points at edge or corner parts of the first surface. The groundplane does not extend under the radiating points. The groundplane is configured as to extend between the radiating points and the feedlines are widened at the radiating points and/or are provided with discrete dielectric elements at the radiating points. The antenna device provides broadband performance and good diversity within a small space.

19 Claims, 17 Drawing Sheets

U.S. PATENT DOCUMENTS

| | | | | |
|---|---|---|---|---|
| 6,157,344 | A | 12/2000 | Bateman et al. | |
| 6,549,170 | B1 | 4/2003 | Kuo et al. | |
| 6,624,790 | B1 | 9/2003 | Wong et al. | |
| 2005/0179598 | A1* | 8/2005 | Legay et al. | 343/700 MS |
| 2005/0225499 | A1* | 10/2005 | Kingsley et al. | 343/911 R |

OTHER PUBLICATIONS

"Array of circular-polarised cross dielectric resonator antennas" Petosa, A, et al., Electronics Letter, IEE Stevenage, GB, vol. 32, No. 19, Sep. 12, 1996.

"Broadband microstrip antennas", G. Kumar & K. P. Ray, Artech House, 2003, pp. 363-372.

PCT International Search Report from PCT/GB2004/000511. Date of mailing Jun. 9, 2004.

"Planar Antennas for WLAN Applications", K-L Wong, National Sun Yat-Sen University, Taiwan, presented at the 2002 Ansoft Workshop and available on the Ansoft website.

"Printed diversity monopole antenna for WLAN operation", T-Y Wu, et al., Electronics Letters, 38, 25, Dec. 2002.

"The handbook of antenna design", O. Rudge, et al., Peter Peregrinus Ltd. 1986.

Search report under section 17 for application No. GB 0402710.8 Date of search Jul. 14, 2004.

* cited by examiner

MULTIPLE ANTENNA DIVERSITY ON MOBILE TELEPHONE HANDSETS, PDAS AND OTHER ELECTRICALLY SMALL RADIO PLATFORMS

CROSS-REFERENCE TO RELATED APPLICATION

This Application is a National Phase application of PCT International Application No. PCT/GB2004/000511, having an International Filing Date Feb. 9, 2004, and claiming priority of Great Britain Patent Application, 0302818.0, filed Feb. 7, 2003, each incorporated by reference herein in their entirety.

FIELD OF THE INVENTION

The present invention relates to techniques for creating multiple antenna diversity on mobile telephone handsets, personal digital assistants and other electrically small radio platforms.

BACKGROUND OF THE INVENTION

Various types of antenna devices exist, including dielectric resonator antennas (DRAs), high dielectric antennas (HDAs), dielectrically loaded antennas (DLAs), dielectrically excited antennas (DEAs) and traditional conductive antennas made out of electrically conductive materials.

DRAs are well known in the prior art, and generally are formed as a pellet of a high permittivity dielectric material, such as a ceramic material, that is excited by a direct microstrip feed, by an aperture or slot feed or by a probe inserted into the dielectric material. A DRA generally requires a conductive groundplane or grounded substrate. In a DRA, the main radiator is the dielectric pellet, radiation being generated by displacement currents induced in the dielectric material.

HDAs are similar to DRAs, but instead of having a full ground plane located under the dielectric pellet, HDAs have a smaller ground plane or no ground plane at all. DRAs generally have a deep, well-defined resonant frequency, whereas HDAs tend to have a less well-defined response, but operate over a wider range of frequencies. Again, the primary radiator in the dielectric pellet.

A DLA generally has the form of an electrically conductive element that is contacted by a dielectric element, for example a ceramic element of suitable shape. The primary radiator in a DLA is the electrically conductive element, but its radiating properties are modified by the dielectric element so as to allow a DLA to have smaller dimensions than a traditional conductive antenna with the same performance.

A further type of antenna recently developed by the present applicant is the dielectrically excited antenna (DEA). A DEA comprises a DRA, HDA or DLA used in conjunction with a conductive antenna, for example a planar inverted-L antenna (PILA) or planar inverted-F antenna (PIFA). In a DEA, the dielectric antenna component (i.e. the DRA, HDA or DLA) is driven, and a conductive antenna located in close proximity to the dielectric antenna is parasitically excited by the dielectric antenna, often radiating at a different frequency so as to provide dual or multi band operation. Alternatively, the conductive antenna may be driven so as parasitically to drive the dielectric antenna.

An important problem facing antenna designers, in particular today where many portable appliances such as computers, mobile telephones, computer peripherals and the like communicate with each other in a wireless manner, is to provide good diversity within a small space. In telecommunications and radar applications it is often desirable to have two or more antennas that give a different or diverse 'view' of an incoming signal. Generally speaking, the different views of the signal can be combined to achieve some optimum or at least improved performance such as maximum or at least improved signal to noise ratio, minimum or at least reduced interference maximum or at least improved carrier to interference ratio, and so forth. Signal diversity using several antennas can be achieved by separating the antennas (spatial diversity), by pointing the antennas in different directions (pattern or directional diversity) or by using different polarisations (polarisation diversity). Antenna diversity is also important fox overcoming the multi-path problem, where an incoming signal is reflected off buildings and other structures resulting in a plurality of differently phased components of the same signal.

A significant problem arises when diversity is required from a small space or volume such that the antennas have to be closely spaced. An example of this is when a PCMCIA card, inserted into a laptop computer, is used to connect to the external world by radio. Most high data rate radio links require diversity to obtain the necessary level of performance, but the space available on a PCMCIA card is generally of the order of about ⅓ of a wavelength. At such a close spacing, most antennas will couple closely together and will therefore tend to behave like a single antenna. In addition, there is little isolation between the antennas and, consequently, there is little diversity or difference in performance between the antennas. As a rule, about −20 dB coupling (isolation) is the target specification between antennas operating on the same band for a PCMCIA card. For access points (in WLAN and the like applications), which are rather like micro-base stations, even greater isolation is required, about −40 dB being desirable. Such high isolation is extremely hard to achieve with conventional antennas when the access points are the size of domestic smoke alarms and less than a wavelength across. Similarly with laptop computers, isolation between WLAN and Bluetooth® antennas of −40 dB or more is seen as desirable.

A method of creating good diversity at the Wireless Local Area Network (WLAN) frequency of 2.4 GHz has been published ["Printed diversity monopole antenna for WLAN operation", T-Y Wu, et. al., Electronics Letters, 38, 25, Dec. 2002]. This paper describes how to remove the ground plane on the underside of a printed circuit board (PCB) so that the end section of a microstrip on the top surface becomes a radiating monopoly. This is shown in FIG. 1 of the present application Wu et al., also describe how a T-shaped section of ground plane between the two antennas can help to increase port isolation between them. Further details are presented in ["Planar Antennas for WLAN Applications", K-L Wong, National Sun Yat-Sen University, Taiwan, presented at the 2002 Ansoft Workshop and available on the Ansoft website].

The antenna system discussed above is relatively narrow band and no method of extending the bandwidth or other aspects of antenna performance, is offered. As described in the paper by Wu et al, this type of antenna does not have sufficient bandwidth to be used in a mobile communications system.

It is part of accepted antenna theory that 'fat' monopoles can be designed to have wider band performance than 'thin' monopoles, see for example, ["The handbook of antenna design", O. Rudge, et al., Peter Peregrinus Ltd, 1986] where rectangular and conical shaped monopoles are shown to have very broadband responses. A recent paper ["Annular planar monopole antennas", Z. N. Chen, et. al., lEE Proc-Microw. Antennas Propag., 149, 4, 200–203, 2002] describes how a monopole shaped as a circular disk or annulus can have broadband impedance and radiation characteristics A recent book ["Broadband microstrip antennas", G. Kumar & K. P. Ray, Artech House, 2003] describes how the fat dipole concepts can be extended to printed microstrip antennas (MSAs). FIG. 2 shows the general design of an MSA and Kumar & Ray show that rectangular, triangular, hexagonal and circular printed microstrip antennas all have broadband properties. U.S. Pat. No. 5,828,346 discloses a diversity card antenna with a pair of monopole antennas mounted in two corners of a printed circuit board (PCB) substrate. The monopoles are formed respectively as F and inverse F antennas, L and inverse L antennas, or F and L antennas so as to provide pattern diversity. The antennas are alternately fed by a switching device so as to eliminate fading.

EP 0 720 252 (AT&T) discloses a multi-branch patch antenna in which four conductive patches are mounted on a dielectric substrate which is itself mounted on a conductive groundplane. A conductive "septum" forms a cross on the sur face of the dielectric substrate, separating the patch antennas, and contacts the groundplane. The patch antennas are located above the groundplane.

All of the references identified above are hereby incorporated into the present application by way of reference, and are thus to be considered as part of the present disclosure.

SUMMARY OF THE INVENTION

According to a first aspect of the present invention, there is provided an antenna device including a dielectric substrate having a first, upper surface and a second, lower surface, a conductive groundplane on the second surface or located between the first and second surfaces, and at least two conductive feedlines formed on the first surface and extending from feed points to predetermined radiating points at edge or coiner parts of the first surface, wherein the group lane does not extend under the radiating points but is configured as to extend between the radiating points, characterised in that the feedlines are provided with discrete dielectric elements at the radiating points.

According to a second aspect of the present invention, there is provided an antenna device including a dielectric substrate having a first, upper surface and a second, lower surface, a conductive groundplane on the second surface or located between the first and second surfaces, and four conductive feedlines formed on the first surface and extending from feed points to predetermined radiating points at edge or corner parts of the first surface, wherein the groundplane does not extend under the radiating points but is configured as to extend between the radiating points, characterised in that two of the radiating points are located at adjacent corner parts of the first surface and two of the radiating points are located at opposed edge parts of the first surface.

In general, the conductive feedlines are supplied with energy at the feed points by way of electrical connections that pass through the dielectric substrate and through gaps or holes in the conductive groundplane. In this way, the electrical connections can be joined to signal lines on the underside of the substrate without shorting to the conductive groundplane. It is preferred to locate the signal lines underneath the groundplane so as to shield the radiating points and thus to reduce possible interference with the radiating characteristics of the antenna device. Other feeding arrangements may be used and will be well known to those of ordinary skill in the art.

The conductive feedlines may be configured as microstrip feedlines printed on the dielectric substrate in a known manner.

In a particularly preferred embodiment of the present invention, there are provided four conductive feedlines and thus four radiating points on the first surface.

In one variation of this embodiment, the dielectric substrate may be generally rectangular in shape with four coiner regions and four edges, with the conductive feedlines extending into the foul corner regions from a region or regions of the first surface above the conductive groundplane. The conductive groundplane is configured so as not to extend into the four corner regions of the substrate, but to extend to all four edges of the substrate. Four radiating points are thus defined on the first surface at the four corner regions.

In an alternative variation of this embodiment, the radiating points may be brought closer together by locating a first pair of radiating points in two adjacent corner regions of the first surface as before, and locating the other two radiating points at opposed edge regions of the first surface of the substrate between the two adjacent coiner regions beaming the first pair of radiating points and the remaining two corner regions. The conductive groundplane is then configured so as not to extend underneath the two radiating points on the opposed edge regions, but may extend into the two corner regions not beating radiating points.

In an alternative embodiment of the present invention, the substrate may be triangular in shape, preferably being an equilateral triangle. As before, the conductive groundplane does not extend into corner regions of the second surface, and three conductive feedlines are provided on the first surface and respectively extend into the three corner regions thereof to define three radiating points.

In general, similar configurations may be provided on any polygonal substrate, for example pentagonal, hexagonal, heptagonal, octagonal and so forth. Indeed, it is not so much the shape of the substrate that is important, but more the relative arrangement of the radiating points and the groundplane. However, given that one aim of embodiments of the present invention is to provide multiple broadband antenna diversity on a small radio platform, it is generally desirable for the substrate to have as mall an area as possible so that it can easily be contained within a small device such as a mobile telephone handset or a WLAN access point. In order to maximise spatial efficiency, the radiating points are advantageously located at corner or edge regions of the first surface of the substrate.

Notwithstanding the above, consideration of the practical aspects of constructing several diversity antennas on an electrically small platform generally leads to the conclusion that an even number of radiating points is preferable to an odd number, and that a particularly preferred number of radiating points (i.e. individual diversity antennas) is four. One reason for this is that four radiating points/antennas can be arranged to point in four directions mutually at right angles to each other, and coupling between the antennas can thus be reduced. Furthermore, driving the four radiating points/antennas pairwise rather than individually enables greater directivity. Four radiating points/antennas is considered to be especially useful for implementing the BLAST® communication technique developed by Lucent®/Bell Labs® for increasing data communication rates.

The feedlines may be printed on the first surface by conventional techniques, and may be made of copper or other suitable conductive materials. Any other suitable techniques may be used to form the feedlines.

To improve broadband operation, the feedlines may be wider or thicker at the radiating points than they are along their lengths. This makes use of the 'fat' monopole technique outlined in the introduction to the present application. The radiating points may accordingly be configured as rectangles, cones, disks, ellipses, annuli, triangles, hexagons, polygons or other regular or irregular shapes.

Alternatively or in addition, the feedlines are provided with discrete dielectric elements at the radiating points so as to operate as DRAs, HDAs, DLAs, or DEAs. The dielectric elements are preferably in the form of ceramic elements have a high relative permittivity, for example $\epsilon r>5$, particularly preferably>10. The precise configuration of the dielectric elements in relation to the ends of the feedlines. determines whether the radiating points act as DRAs, HDAs, DLAs or DEAs, as will be explained in more detail in the examples given hereinafter.

The dielectric elements may have any appropriate shape depending on the operating requirements of the antenna device. In currently preferred embodiments, the elements may have a wedge shape or be configured as a sector of a cylinder with a pointed end and a curved side. The pointed end may face outwardly from the corner region, or may face inwardly. In other embodiments, the elements may have a generally oblong shape. Other shapes may be used as required, for example: triangular prisms, triangular prisms with rounded corners, elongate thin curved elements, bridge-shaped elements, elements shaped as sections cut along a chord of a cylinder, and all of the shapes described here but having a top surface that curves down towards the edge of the dielectric substrate on which the elements are mounted rather than having a flat fop surface generally parallel to the substrate.

In preferred embodiments, the dielectric elements are soldered or otherwise attached on top of the feedlines in the corner or edge regions of the first surface of the substrate. Alternatively, the ends of the feedlines may be attached to a vertical side surface of the dielectric elements, or even extend on to top surfaces of the dielectric elements. The surfaces of the dielectric elements that contact the ends of the feedlines may be metallised, and in some embodiments at least inwardly facing side surfaces of the dielectric elements may also be metallised so as to improve isolation between the radiating points.

In some embodiments of the present invention, it is important that the dielectric elements are positioned on the first surface so that they do not overlap the groundplane, otherwise the antenna device will not function correctly. This is generally the case when the dielectric elements are configured to operate as DLAs or dielectrically loaded monopoles. In other embodiments, however, it is permissible for the dielectric elements to overlap the groundplane, for example when the elements are configured to operate in particular HDA modes.

BRIEF DESCRIPTION OF THE DRAWINGS

For a better understanding of the present invention and to show how it may be carried into effect, reference shall now be made by way of example to the accompanying drawings, in which.

DETAILED DESCRIPTION OF THE INVENTION

Figure 1:
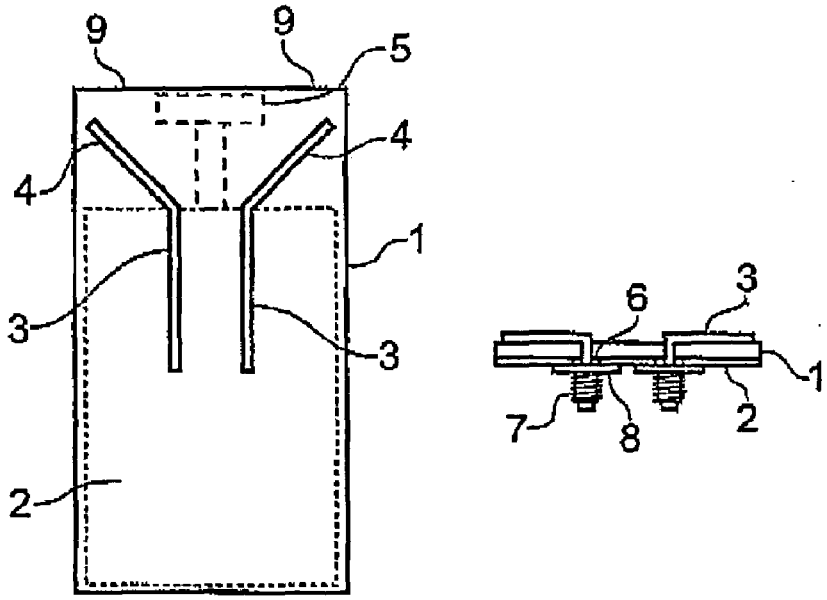
Fig. 1 PRIOR ART
FIG. 1 shows a prior art WLAN antenna device.

FIG. 1 shows a prior art printed microstrip dual monopole antenna device, including a dielectric substrate 1 in the form of an FR4 PCB, a main conductive groundplane 2 on the underside of the substrate 1, two printed microstrip lines 3 on the upper side of the substrate 1, the lines 3 terminating in two radiating sections 4, and a small 'T'-shaped section of groundplane 5 on the underside of the substrate 1 in a location between the two radiating points 4.

FIG. 1 also shows the device in cross-section, where it can be seen how the two microstrip lines 3 pass from the upper side of the substrate 1 to its lower side through a pair of gaps or holes 6 in the groundplane 2, and terminate in a pair of SMA connectors 7 which are electrically isolated from the groundplane 2 by insulating washers 8.

The two microstrip lines 3 are configured such that the radiating sections 4 point towards corners 9 of the substrate 1 and air disposed at 90 degrees to each other. No groundplane 2 is provided underneath the radiating sections 4.

This prior art antenna device has a narrow bandwidth in operation, and is acknowledged in the prior art to be unsuitable for mobile communications for this reason.

Figure 2:
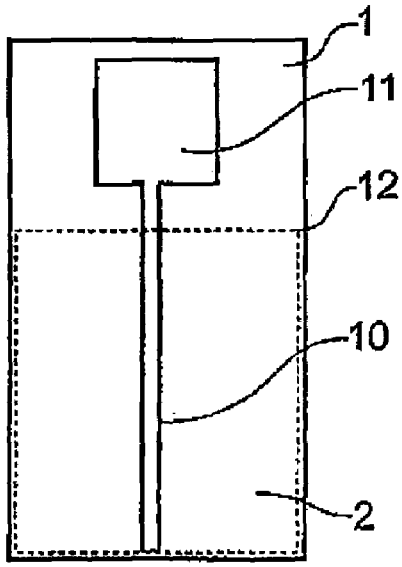
Fig. 2 PRIOR ART
FIG. 2 shows a prior art printed 'fat' monopole antenna device.

FIG. 2 shows another prior art antenna device, also comprising a dielectric substrate 1 with a conductive groundplane 2 on its underside and a printed microstrip line 10 on its upper side. The line 10 terminates in a 'fat' section 11, which is significantly wider then the main section of the line 10, so as to define a radiating section 11. No groundplane 2 is provided under the radiating section 11. An edge 12 of the groundplane 2 acts as a groundplane for the radiating section 11. This antenna device has good bandwidth, but does not provide antenna diversity.

Figure 3:
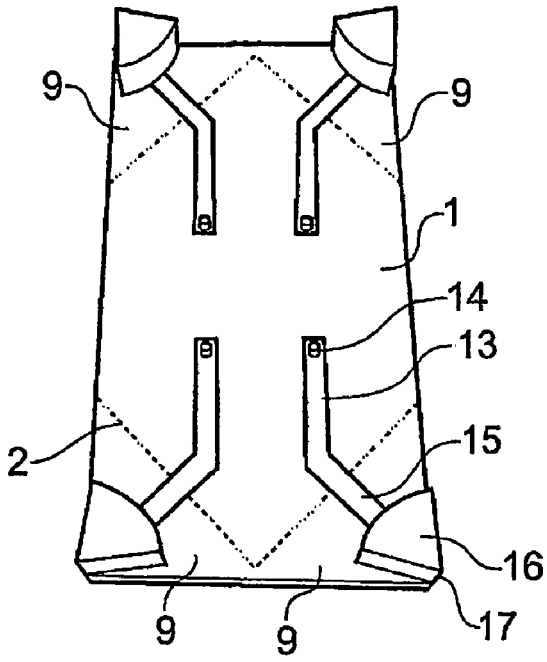
FIG. 3 shows a first embodiment of the present invention.

FIG. 3 shows a first preferred embodiment of the present invention, comprising a dielectric substrate 1 in the form of an FR4 or Duroid® PCB. An underside of the substrate 1 is provided with a conductive groundplane 2 by metallization or any other suitable process. The conductive groundplane 2 extends to the edges of the substrate 1, but does not extend into the coiners 9. In this embodiment, the groundplane 2 can be seen to have a generally hexagonal shape. Four feedlines 13 extend across the upper surface of the substrate 1 from feed points 14 to coiner regions 9. The feedlines 13 are disposed in a mutually parallel configuration in a central part of the upper surface of the substrate 1 (although it is sometimes preferred that the feedlines 13 are arranged at 90 degrees to each other. In the central part of the substrate 1), and are then diverted into the corner regions 9 so that end sections 15 of the feedlines 13 are disposed mutually at right angles to each other. Not visible in FIG. 3 are connectors on the underside of the substrate 1 that provide connections to the feed points 14 from the underside of the substrate 1 in a similar manner the prior art device of FIG. 1. A wedge shaped ceramic dielectric element 16 is soldered onto the end section 15 of each feedline 13, with a pointed edge 17 of each element 16 pointing outwardly from its respective corner legion 9. The dielectric elements 16 together with the end sections 15 of the feedlines 13 act as wideband antennas when an appropriate signal is input to the feed points 14. Each end section 15 and its associated dielectric element 16 defines a radiating point in the context of the present application. It will be noted that the groundplane 2 extends, on the underside of the substrate 1, to edge parts of the substrate 1 between the radiating points, thus helping to provide isolation between the radiating points.

Figure 4:
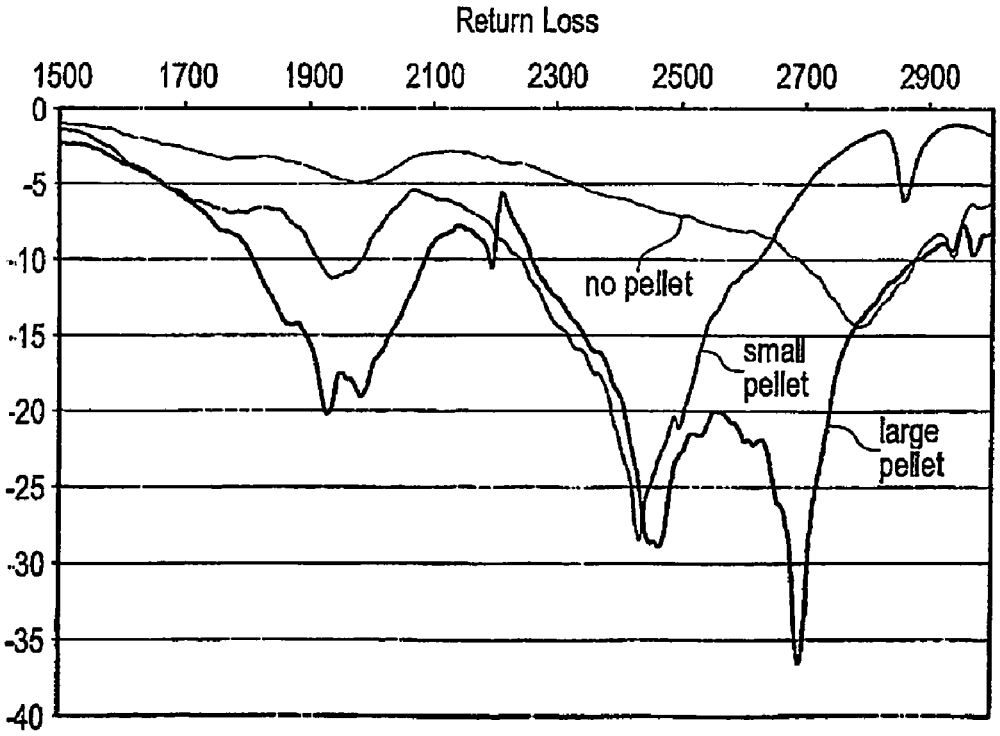
FIG. 4 shows an $S_{11}$ return loss plot for the embodiment of FIG. 3.

FIG. 4 (line marked "no pellet") shows the $S_{11}$ return loss for one of the four end sections 15 before application of a dielectric ceramic element 16. The gain of the antenna defined by this single end section 15 is about 1 dBi. When a small piece of dielectric ceramic material is added, the second $S_{11}$ profile (line marked "small pellet") is produced which shows increased bandwidth and up to 3 dBi gain. A larger piece of ceramic element produces the third $S_{11}$ profile (line marked "large pellet") and positive gain across a very large bandwidth. The bandwidth, as measured at the −6 dB level, stretches from 1700 MHz to beyond 3 GHz, although the return loss is marginal at a frequency near 2200 MHz. It is this antenna, with the larger ceramic elements 16, that is shown in FIG. 3.

With the ceramic elements 16 in the position shown in FIG. 3 (i.e. with the corner 17 of the element 16 in the corner 9 of the substrate pointing away from the groundplane 2), adding a second ceramic element 16 on the adjacent corner 9 causes some detuning of the first antenna. This behaviour is consistent with the idea that the antenna is a dielectrically loaded monopole or DLA. If the element 16 is moved towards the groundplane 2 such that it overlaps the groundplane 2, then the antenna does not work at all.

Figure 5:
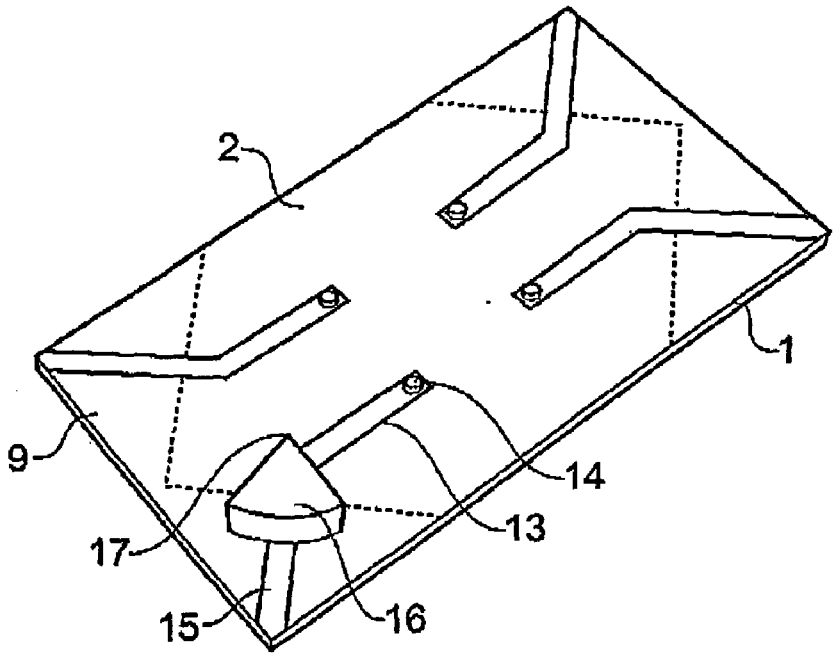
FIG. 5 shows an alternative dielectric element orientation for the embodiment of FIG. 3.

If the element 16 is rotated and positioned as shown in FIG. 5, a second element 16 in an adjacent corner 9 does not detune the first and the antenna therefore appears to be acting as a high dielectric antenna (HDA) rather than as a dielectrically loaded monopole. In this embodiment, it is permissible, in fact desirable, for the element 16 to overlap the groundplane 2. It will be appreciated that an antenna device of an alternative embodiment of the present invention may be obtained by providing three further equivalent dielectric elements 16 in the corners 9 of the partial structure shown in FIG. 5.

Figure 6:
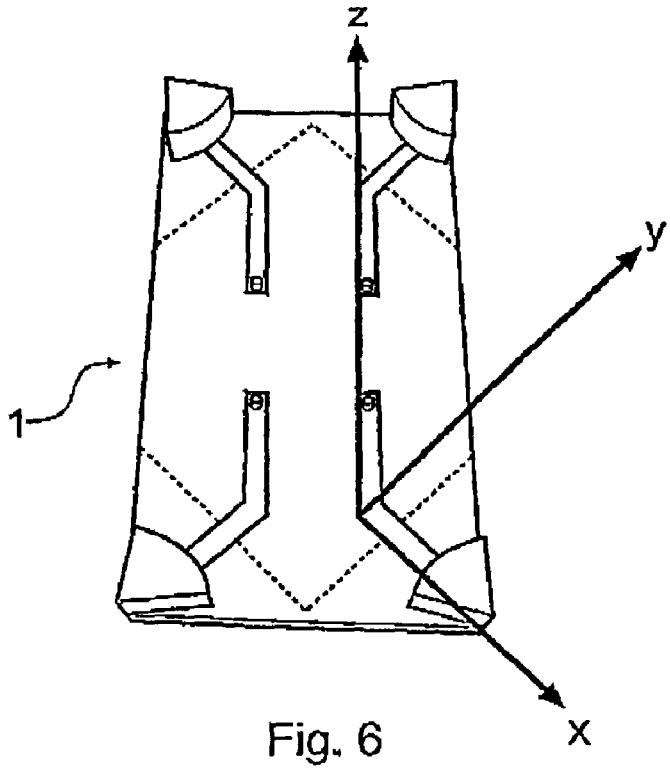
FIG. 6 shows the embodiment of FIG. 3 in relation to a coordinate system used for antenna performance measurements of FIGS. 7 to 12.

FIG. 6 shows the embodiment of FIG. 3 with a Cartesian co-ordinate system shown superimposed on the Figure. The z axis is vertically up from the substrate 1, with the x and y axes in the plane of the substrate 1.

FIGS. 7 to 12 show the radiation pattern of one of the antennas (i.e. radiating section 15 and dielectric element 16) of the device of FIG. 6 at frequencies of 1900 MHz, 1967 MHz, 2034 MHz, 2101 MHz and 2168 MHz with reference to the co-ordinate system of FIG. 6.

Figure 7:
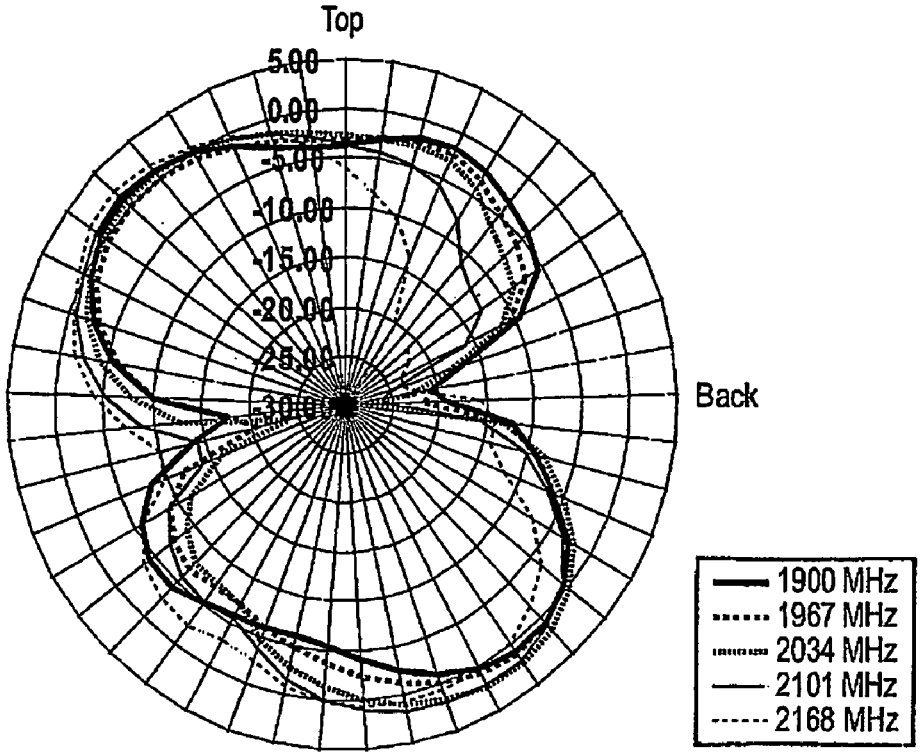
FIGS. 7 to 12 show various experimentally measured radiation patterns for the antenna device of FIG. 3.
Figure 8:
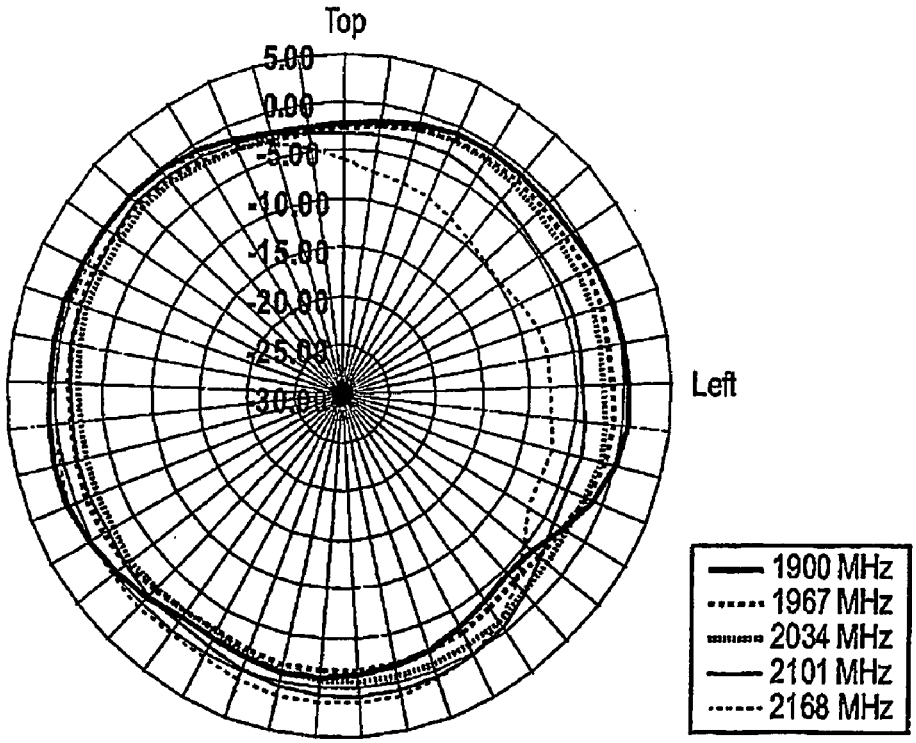
Figure 9:
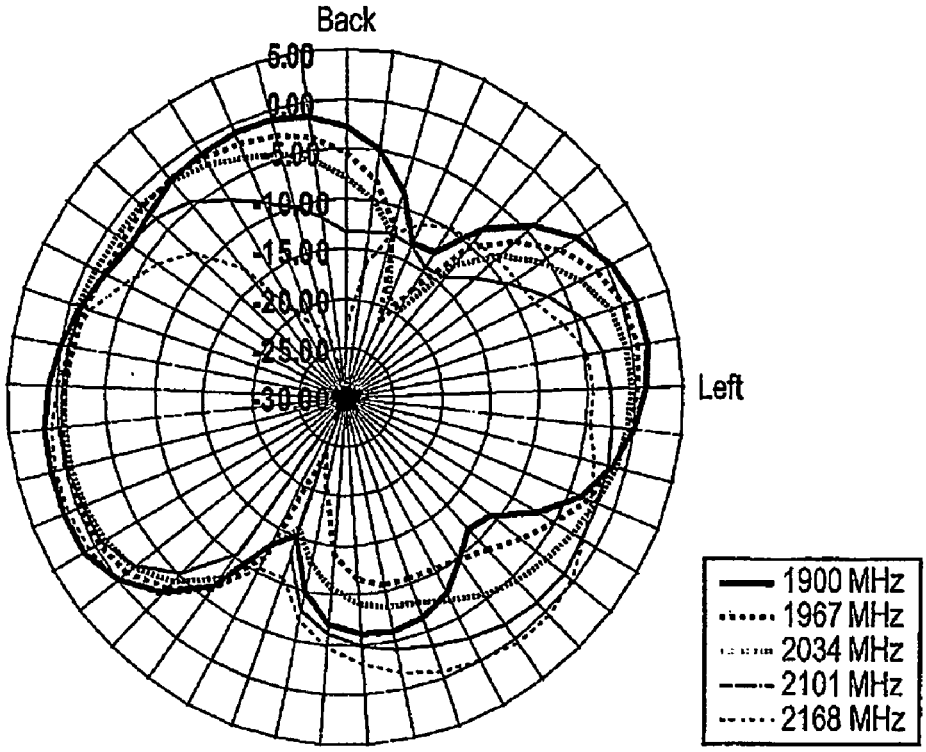
Figure 10:
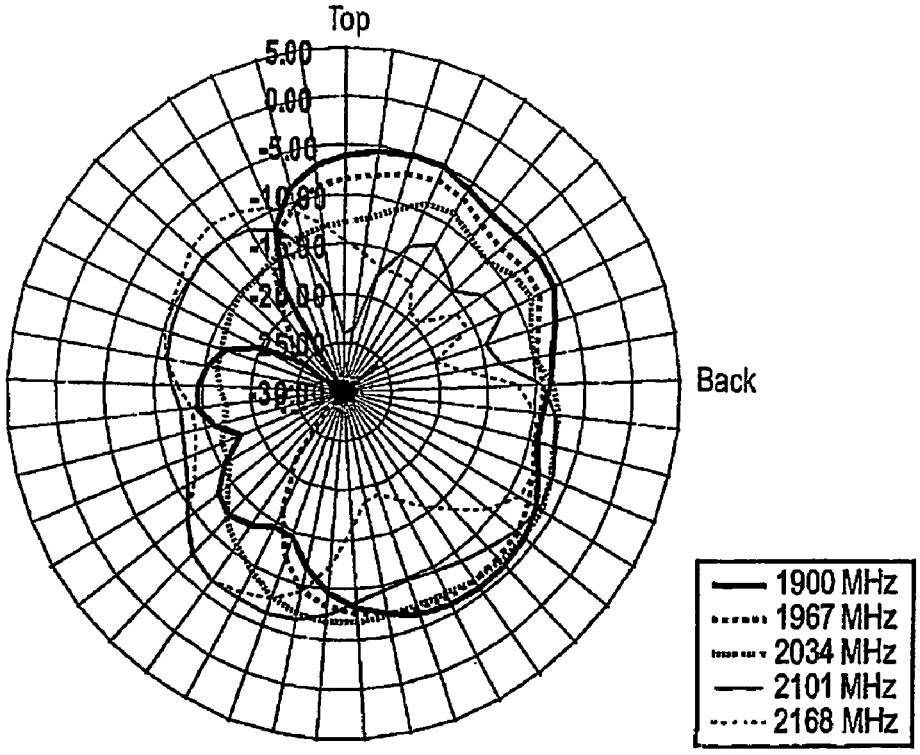
Figure 11:
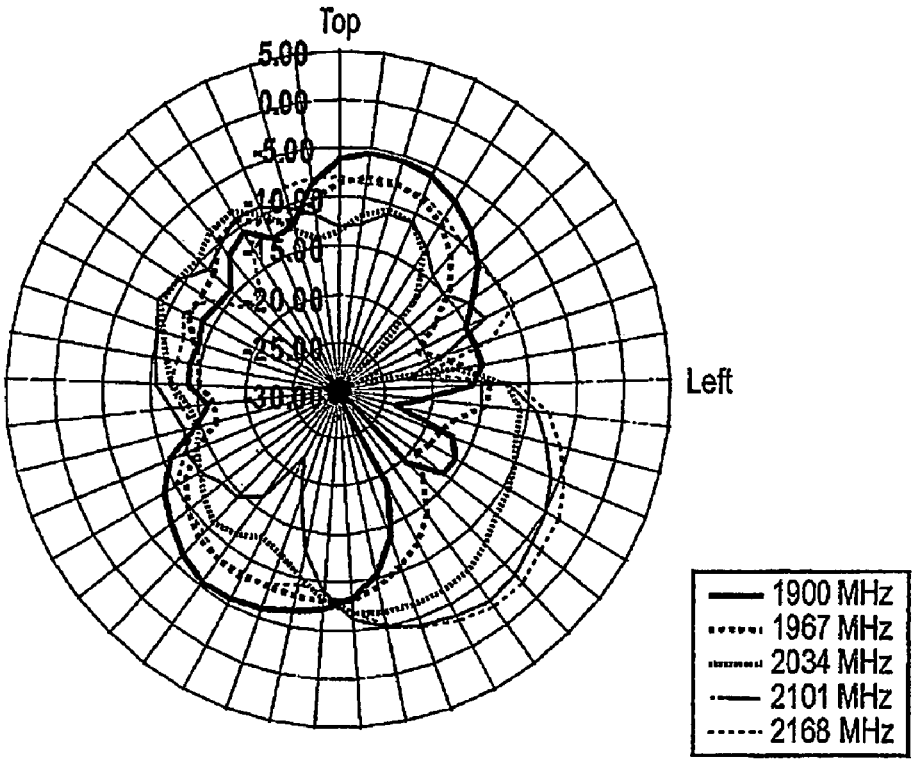
Figure 12:
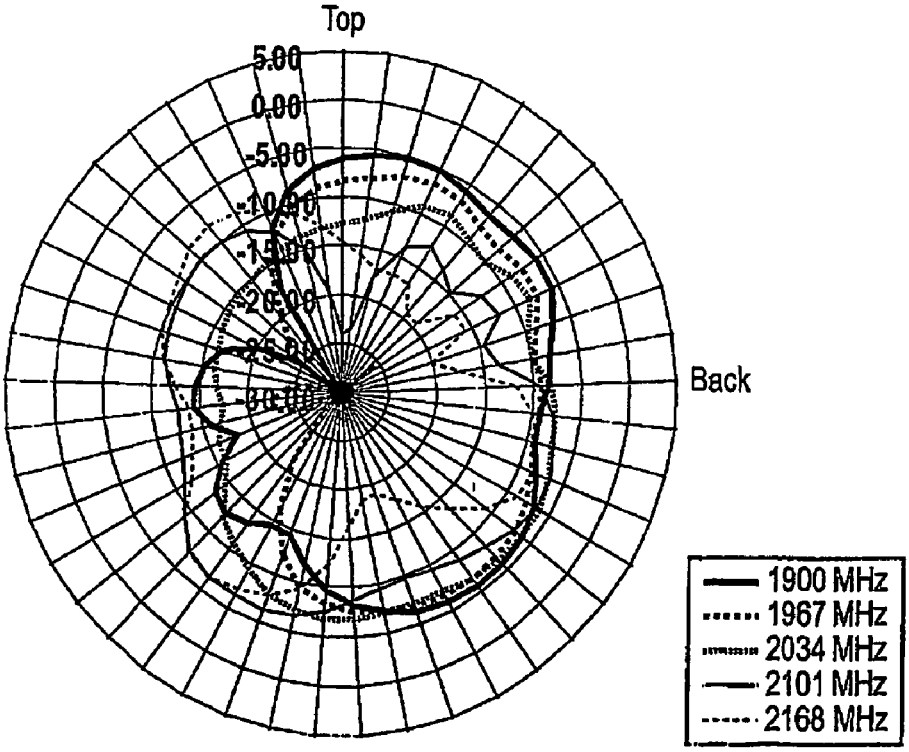

Specifically, FIG. 7 shows the xz plane co-polar radiation pattern, FIG. 8 shows the yz plane co-polar radiation pattern, FIG. 9 shows the xy plane co-polar radiation pattern, FIG. 10 shows the xz plane cross-polar radiation pattern, FIG. 11 shows the yz plane cross-polar radiation pattern and FIG. 12 shows the xy plane cross-polar radiation pattern.

Figure 13:
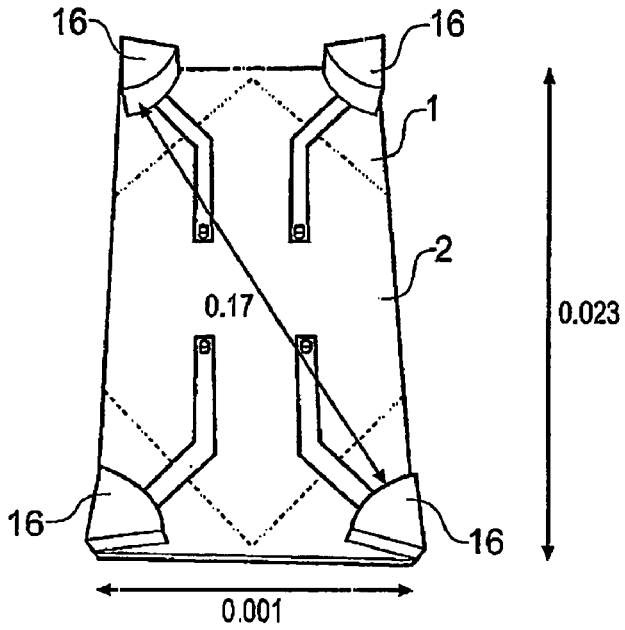
FIG. 13 shows the embodiment of FIG. 3 with reference to 3-D cross-correlation coefficients.

FIG. 13 shows the antenna device of FIG. 3 with an indication of the 3-D cross-correlations between the antenna radiation patterns of FIGS. 7 to 12, these having been calculated using an Ansoft HFSS® electromagnetic simulation package. The diagonal cross-correlation coefficient is 0.17, the cross-correlation coefficient across the width of the substrate 1 is 0.001 and the cross-correlation coefficient across the length of the substrate 1 is 0.023. These figures indicate that the embodiment of FIG. 3 with an arrangement of four antennas has excellent potential for creating diversity on a mobile telephone handset, for example.

Antenna diversity can be created by polarisation diversity, spatial diversity or pattern/directional diversity. A major reason for the low cross-correlation figures shown in FIG. 13 is due to polarisation diversity, but the different beam directions are helping as well. It has been found that directional diversity can be enhanced at the expense of bandwidth by manipulating the position of the dielectric element 16 on the dielectric substrate 1 and optimising the gap between the element 16 and the groundplane 2 underneath the substrate 1.

Figure 14:
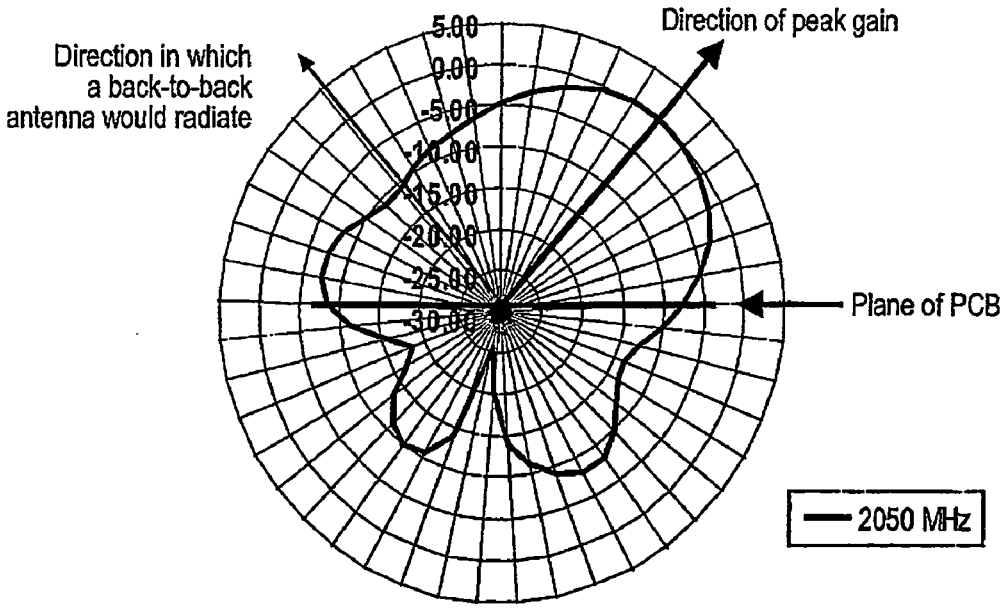
FIG. 14 shows a radiation pattern formed by a particularly preferred embodiment of the present invention.

FIG. 14 shows an example of a beam pattern that is expected to give rise to good directional diversity. In this configuration, the area of groundplane 2 removed beneath each dielectric element 16 and radiating section 15 is smaller than that removed from the antenna used to measure the plots in FIGS. 7–12. The antenna device has good diversity and a low front-to-back ratio, where the 'back' direction is defined as the direction of maximum radiation of a similar antenna disposed back-to-back. (Usually, the backlobe direction is taken to be 180 degrees from the front lobe, in the same plane, i.e. down through the PCB substrate in this case. However, it makes more sense in the present context to define the backlobe of a first antenna element as being in the same direction as the forward lobe of a second antenna element, which is disposed back-to-back with the first antenna element). Note that an antenna with the same polarisation, but facing backwards instead of forwards (and thereby having an image of the pattern shown reflected about the vertical axis) would have a significantly different gain; about 11 dB lower in this case. This difference is exactly what is required to create beam diversity between antennas having the same polarisation. This antenna has a bandwidth of about 200 MHz, much lower than that of the antenna device used for FIGS. 7–12, Isolations between four antennas of the type having the radiating characteristics shown in FIG. 14, disposed on the corners 9 of a substrate 1 as before, vary from 7–15 dB.

In summary, the results presented show that placing antennas at corners of a handset can create an antenna system having a very wide impedance bandwidth and effective radiation patterns with positive dBi gain from 1.7–3 GHz Up to four antennas can be fitted onto a handset PCB. The antennas have very low cross correlations indicating that excellent diversity should be obtained from this antenna system.

Figure 15:
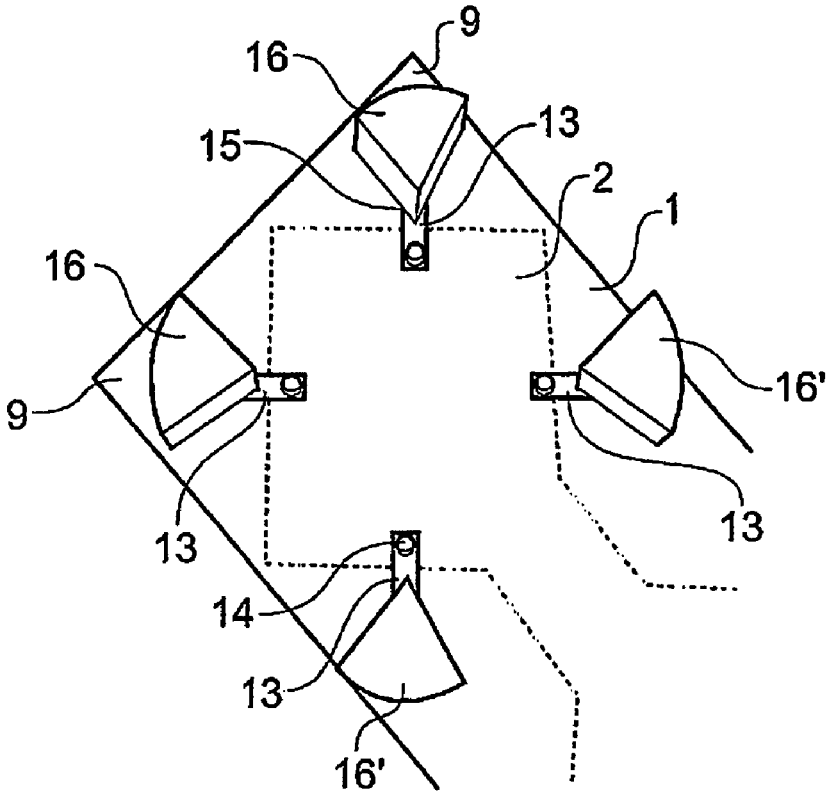
FIG. 15 shows a second, compact embodiment of the present invention.
Figure 16:
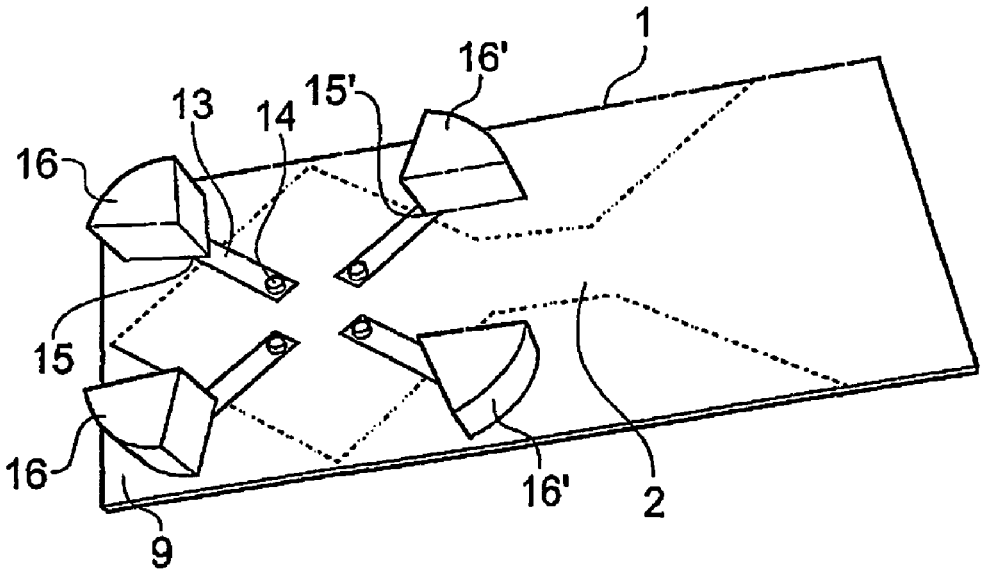
FIG. 16 shows an alternative compact embodiment of the present invention.

FIGS. 15 and 16 show an alternative, compact embodiment of the present invention, with like parts being numbered as before. The feedlines 13 are arranged so as to be at 90 degrees to each other in the plane of the substrate 1. Again, two of the radiating sections 15 and associated dielectric elements 16 are located in adjacent corner regions 9 of the dielectric substrate. However, the remaining two radiating sections 15' and dielectric elements 16' are located at edge regions of the substrate 1 rather than in coiner regions, with the groundplane 2 removed from the underside of the substrate 1 underneath the radiating sections 15' and dielectric elements 16' located on the upper side of the substrate 1. In this way, the radiating sections 15, 15' and dielectric elements 16. 16' are clustered together more compactly than in the embodiment of FIG. 3, but are still all isolated from each other by the shape of the groundplane 2 on the underside of the substrate 1. This arrangement has the advantage that the antenna elements can be clustered closely around the RF radio electronics (not shown) which will be located between the antenna elements, generally on the underside of the substrate 1. By shortening the lengths of the feedlines 13, a reduction in RF losses is expected, although there may be a slight disadvantage resulting from increased electromagnetic coupling between the antenna elements since they are closer together. The embodiment of FIG. 15 has shorter feedlines than that of FIG. 16. The dielectric elements 16, 16' of FIGS. 15 and 16 are disposed on the substrate 1 so as to be configured, with the radiating sections 15, 15', as HDAs.

Figure 17:
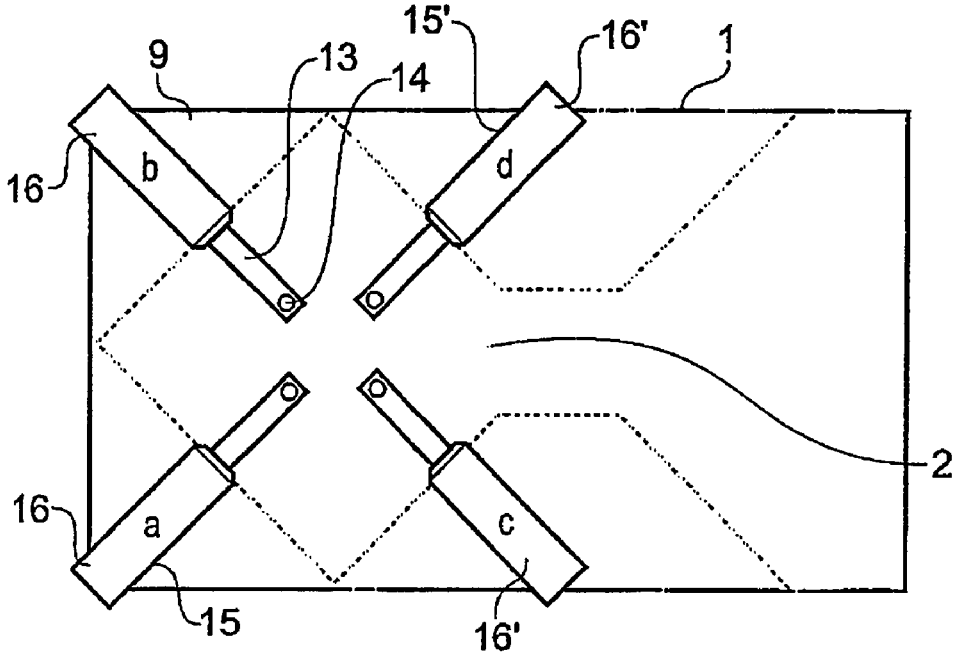
FIG. 17 shows a further variation of the compact embodiment of FIGS. 15 and 16.

FIG. 17 shows a similar arrangement to that of FIGS. 15 and 16, but with low profile oblong dielectric elements 16, 16' soldered onto the radiating sections 15, 15'

The particular shape of the groundplane 2 of the embodiments of FIGS. 15 to 17 may be defined as being "comet"-shaped. Starting with a rectangular groundplane with two longer sides and two shorter sides, a trapezoidal section is removed from each of the two longer edges, and a corner section is removed from each side of one of the shorter edges. In this way, the radiating points are isolated from each other by positions of the groundplane while still leaving sufficient groundplane for mounting various other items of control electronics (not shown) on the PCB substrate.

FIG. 18 to 21 show the reflection and transmission plots and $S_{21}$ radiation patterns measured, respectively, for each of antenna elements a, b, c and d of the embodiment of FIG. 17, thereby giving an indication of $S_{11}$ impedance bandwidth and $S_{121}$ transmission loss for various antenna elements a, b, c and d.

Figure 22:
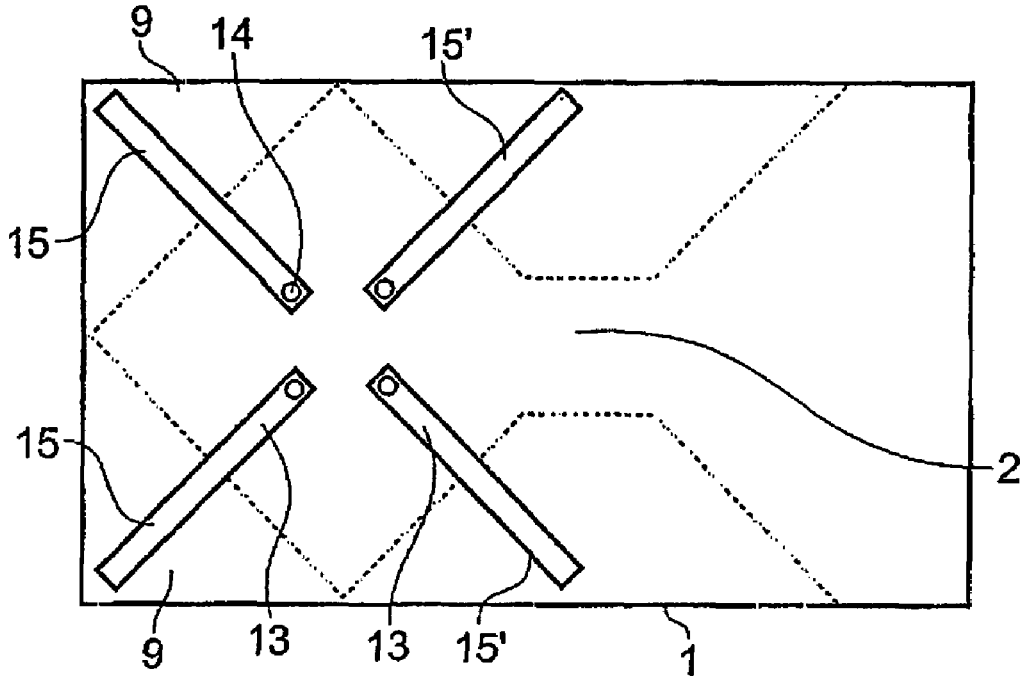
FIG. 22 shows further variation of the compact embodiment, without any dielectric elements at the radiating points.

FIG. 22 shows an embodiment of the second aspect of the present invention, with like parts being numbered as before. This embodiment uses the same "comet"-shaped groundplane 2 as in FIGS. 15 to 17, but does not include dielectric elements at the radiating points, nor does it employ 'fat' monopoles at the radiating sections 15, 15'. This may be considered to be a microstrip antenna (MSA).

Figure 18:
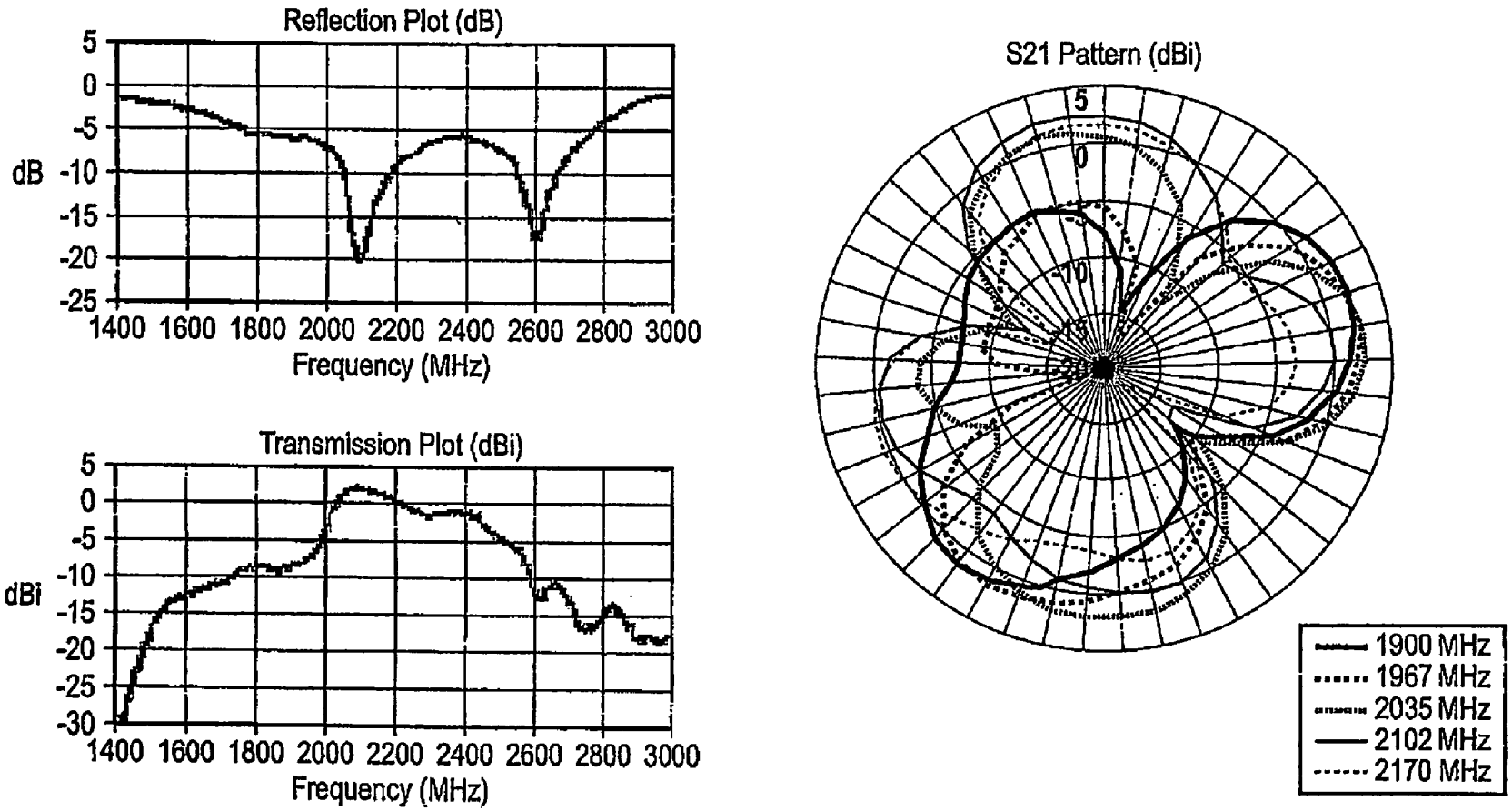
FIGS. 18 to 21 show reflection and transmission plots and a radiation pattern for each of the radiating points of the embodiment of FIG. 17.
Figure 19:
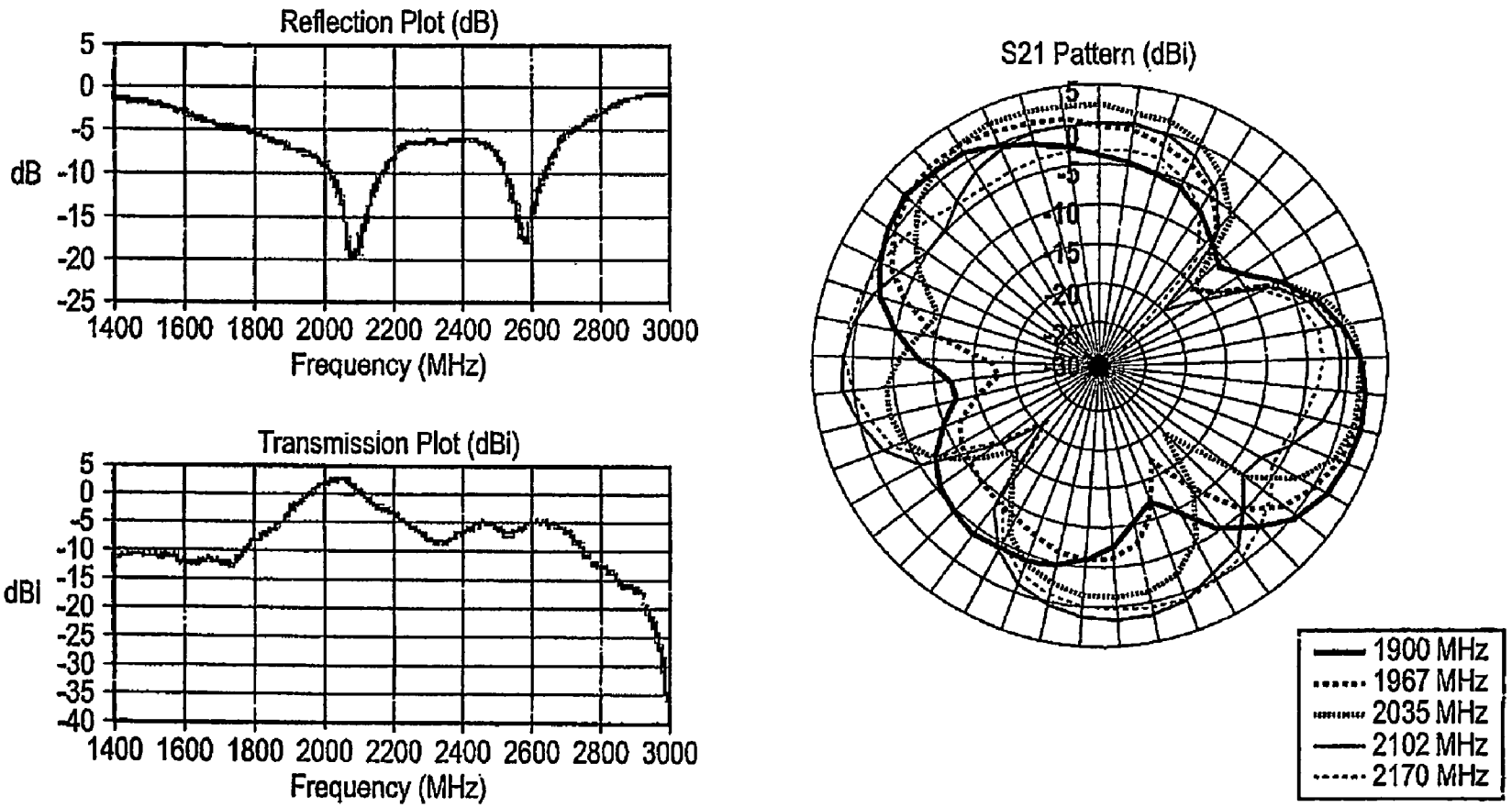
Figure 20:
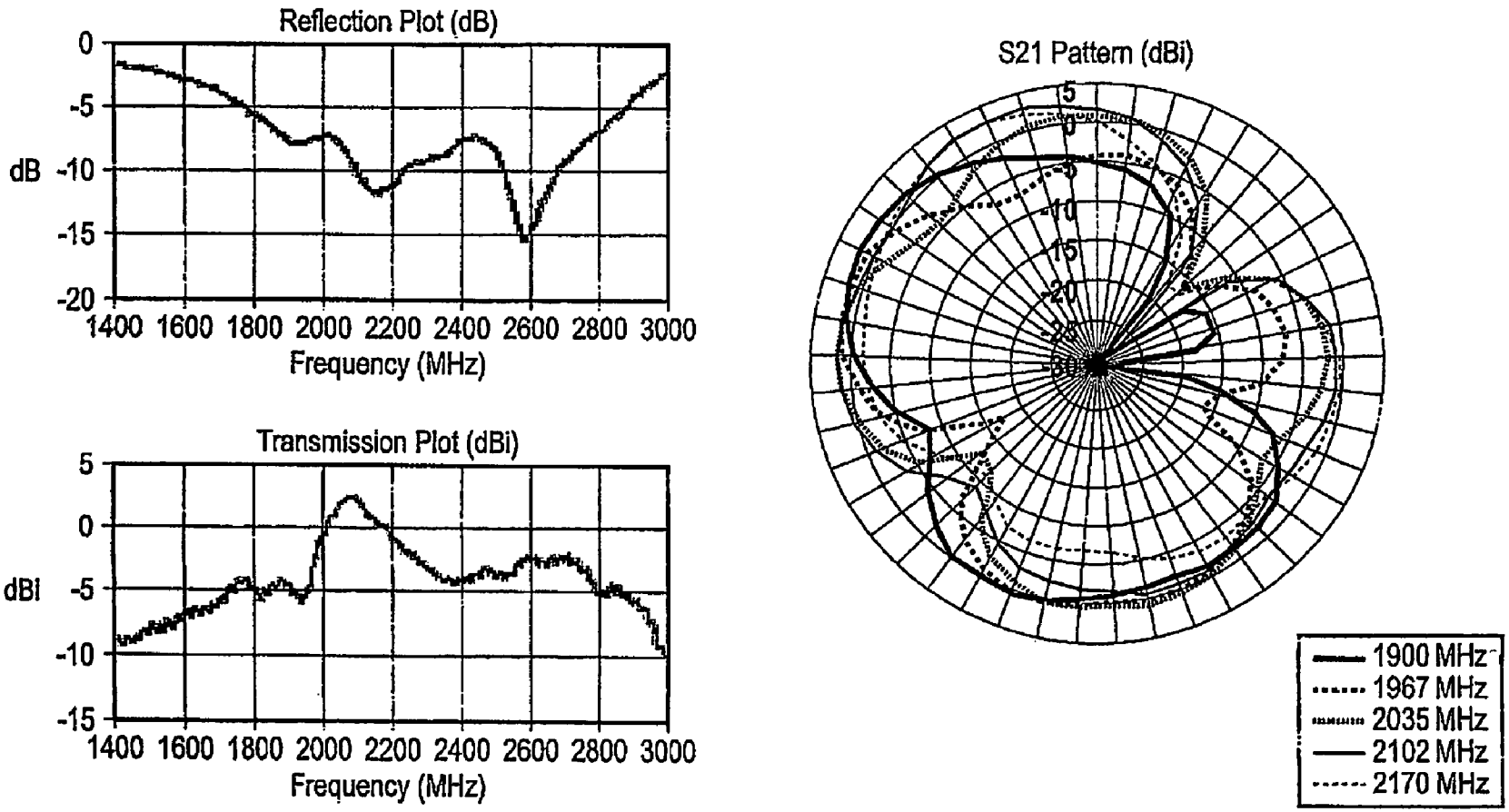
Figure 21:
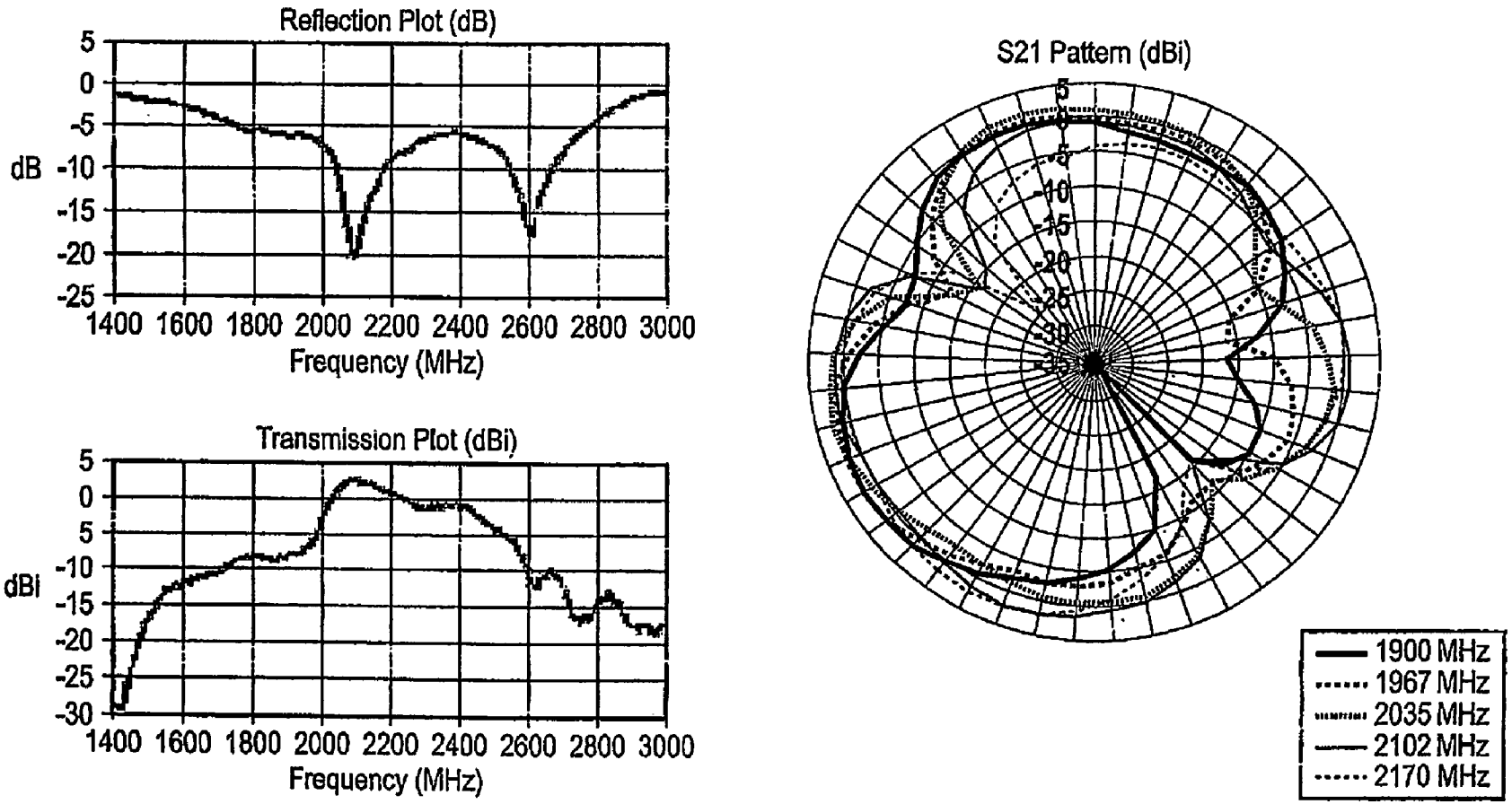
Figure 23:
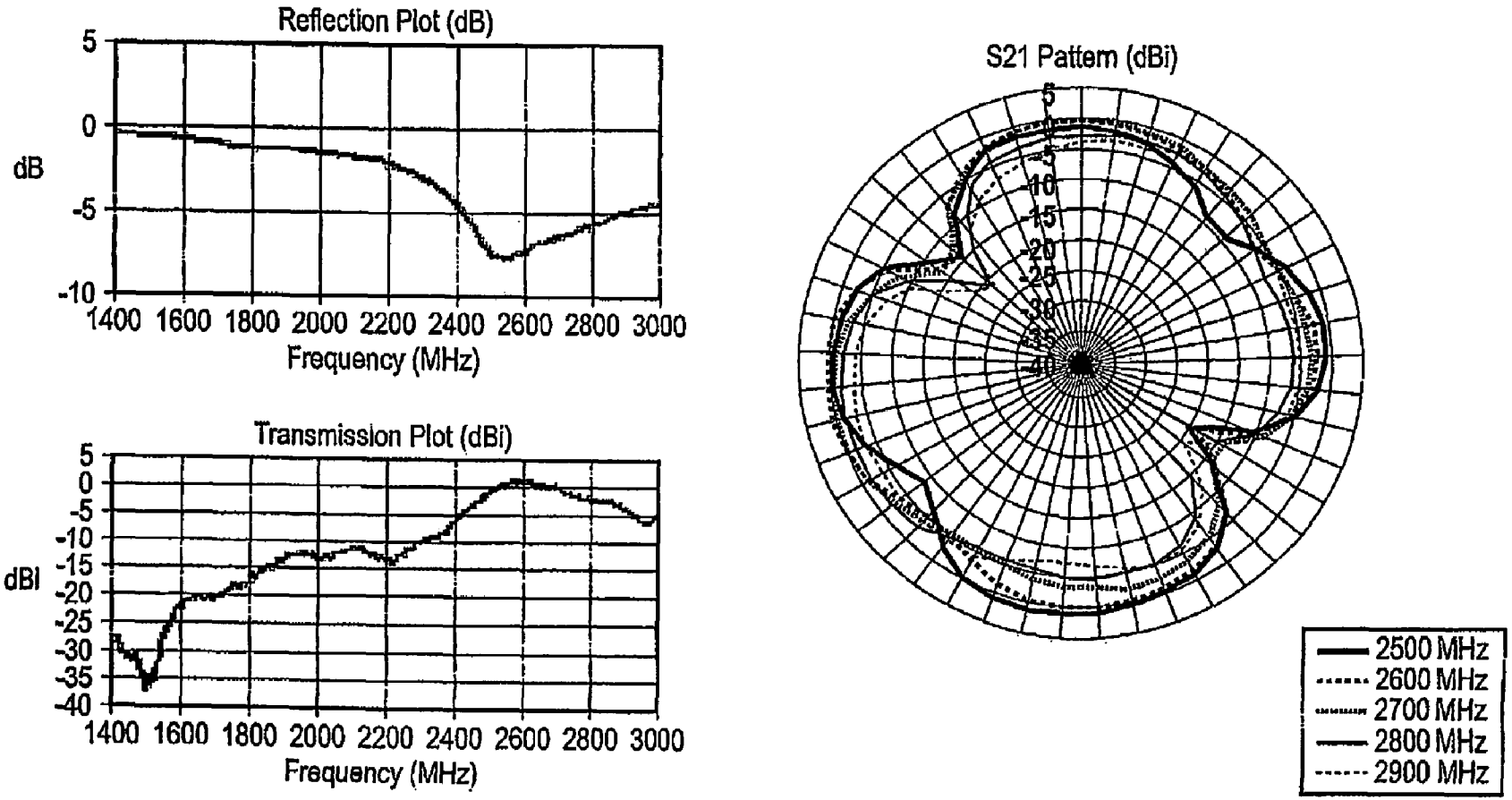
FIG. 23 shows reflection and transmission plots and a radiation pattern for one of the radiating points of the embodiment of FIG. 22.

FIG. 23 shows the reflection and transmission plots and radiation patterns for the antenna element defined by the radiating section 15 at position a, and may be compared with the plots shown in FIG. 18 for the equivalent antenna with a dielectric element of FIG. 17 It can be seen that the antenna element a of FIG. 22 radiates with good bandwidth, but starting at a higher frequency and with lower gain.

Figure 24:
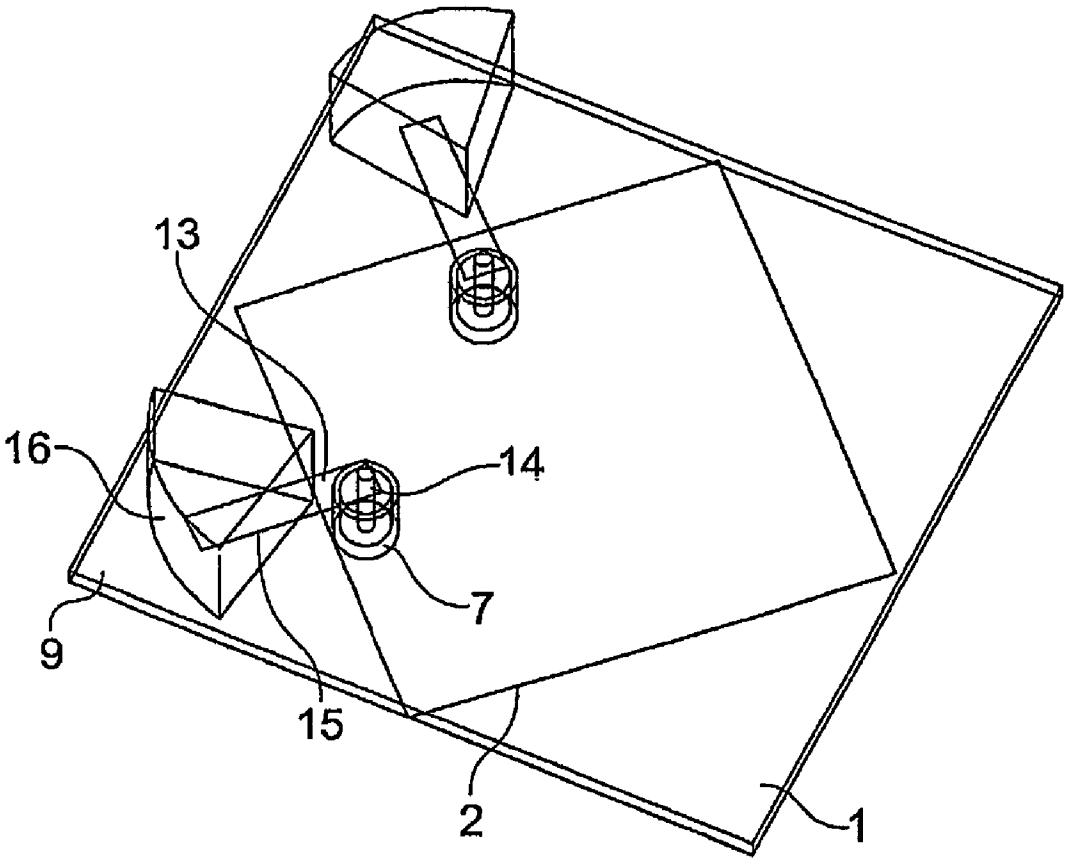
FIGS. 24 to 26 show various geometries for an antenna device of the present invention.
Figure 26:
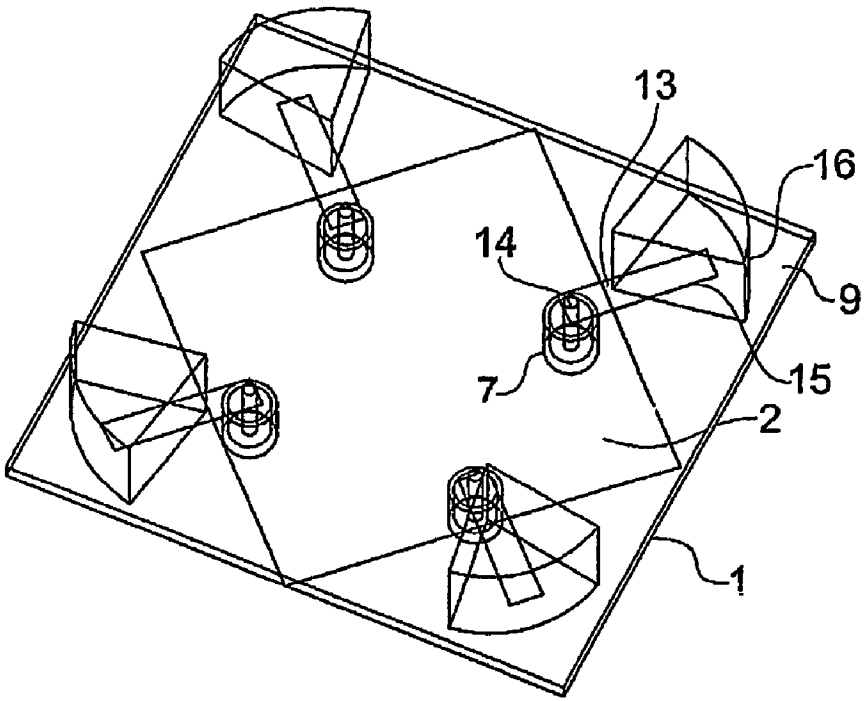
Figure 25:
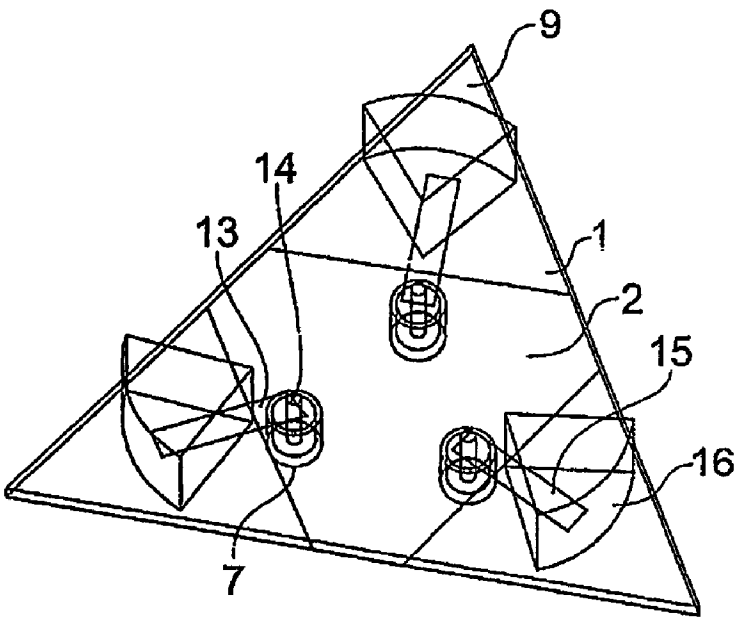

FIGS. 24 to 26 show three different antenna geometries, with like parts being numbered as before.

Referring now to FIG. 24, it has been found by computer simulation that two antenna elements, each comprising a radiating section 15 and dielectric element 16, disposed orthogonally to each other, provides reasonable isolation of −10.6 dB and low cross-correlation coefficient of 0 13, suggesting that this is a good arrangement for diversity.

When three antenna elements are disposed in a triangular configuration with the maximum possible angle between the planes of polarisation (expected to give the best diversity), as shown in FIG. 25, the isolation is poor at −5.3 dB and the cross-correlation coefficient is similarly poor at 0 41. This is not a good arrangement for diversity.

When four antenna elements are clustered with 90° rotations between them, as shown in FIG. 26, the worst isolation (across the diagonals) is better at −6.8 dB and the worst cross-correlation coefficient (again across the diagonals) is similarly better at 0.32. The cross correlation coefficient between adjacent side elements is exceptionally good at 0.017. Clearly this is an excellent arrangement for diversity.

If five elements were to be used, the situation would be worse than fox three elements as there would only be 72° between polarisation planes instead of 120°.

Two or four elements thus present the best opportunity to get diversity on a handset, with four being preferable because of the increased diversity options and the possibility of implementing multiple-input multiple-output communications techniques such as the Lucent® BLAST® method.

The preferred features of the invention are applicable to all aspects of the invention and may be used in any possible combination.

Throughout the description and claims of this specification, the words "comprise" and "contain" and variations of the words, for example "comprising" and "comprises", mean "including but not limited to", and are not intended to (and do not) exclude other components, integers, moieties, additives or steps.

The invention claimed is:

1. An antenna device including a dielectric substrate having a first, upper surface and a second, lower surface, a conductive groundplane on the second surface or located between the first and second surfaces, and at least two conductive feedlines formed on the first surface and extending from feed points to predetermined radiating points at edge or corner parts of the first surface, wherein the groundplane does not extend under the radiating points but is configured as to extend between the radiating points, characterised in that the feedlines are provided with discrete dielectric elements at the radiating points.

2. A device as claimed in claim 1, wherein the feedlines are microstrip feedlines.

3. A device as claimed in claim 1, wherein there are provided four feedlines and thus four radiating points on the first surface.

4. A device as claimed in claim 3, wherein the substrate is generally rectangular in shape with four corner parts and four edge parts, and wherein each feedline extends into a respective corner part.

5. A device as claimed in claim 3, wherein the substrate is generally rectangular in shape with four, corner parts and four edge parts, and wherein two feedlines extend respectively into adjacent corner parts, and two feedlines extend respectively to opposed edge parts each adjacent to one of the adjacent corner parts.

6. A device as claimed in claim 3, wherein the feedlines are electrically connected to driving circuitry in such a way that the feedlines can be driven pairwise rather than individually.

7. A device as claimed in claim 1, wherein there are provided two feedlines and thus two radiating points on the first surface.

8. A device as claimed in claim 7, wherein the two feedlines extend into two adjacent coiner parts of the first surface.

9. A device as claimed in claim 1, wherein the feedlines are disposed at adjacent radiating points so as to be mutually at tight angles to each other.

10. A device as claimed in claim 1, wherein the feedlines are widened at the radiating points and configured with rectangular, conical, circular, elliptical, annular or polygonal shapes.

11. A device as claimed in claim 1, wherein the feedlines are provided with dielectric ceramic elements at the radiating points.

12. A device as claimed in claim 11, wherein the ceramic elements are soldered onto the feedlines at the radiating points.

13. A device as claimed in claim 11, wherein the ceramic elements are metallised on surfaces thereof that contact the feedlines.

14. A device as claimed in claim 11, wherein the ceramic elements are shaped as sectors of a cylinder having a pointed edge and a rounded edge.

15. A device as claimed in claim 14, wherein the ceramic elements are disposed on the first surface such that the pointed edges point mutually outwardly.

16. A device as claimed in claim 14, wherein the ceramic elements are disposed on the first surface such that the pointed edges point mutually inwardly.

17. A device as claimed in claim 11, wherein the ceramic elements have an oblong shape and are disposed in alignment with the feedlines at the radiating points.

18. A device as claimed in claim 1, wherein the feedlines are widened at the radiating points.

19. An antenna device including a dielectric substrate having a first, upper surface and a second, lower surface, a conductive groundplane on the second surface or located between the first and second surfaces, and four conductive feedlines formed on the first surface and extending from feed points to predetermined radiating points at edge or corner parts of the first surface, wherein the groundplane does not extend under the radiating points but is configured as to extend between the radiating points, characterised in that two of the radiating points are located at adjacent corner parts of the first surface and two of the radiating points are located at opposed edge parts of the first surface.

* * * * *